US005743435A

United States Patent [19]

Tomic

[11] Patent Number: 5,743,435

[45] Date of Patent: Apr. 28, 1998

[54] BAG-IN-BOX AND METHOD AND APPARATUS FOR MAKING THE SAME

[75] Inventor: Mladomir Tomic, Appleton, Wis.

[73] Assignee: Reynolds Consumer Products, Inc., Appleton, Wis.

[21] Appl. No.: 876,142

[22] Filed: Jun. 13, 1997

Related U.S. Application Data

[63] Continuation of Ser. No. 678,020, Jul. 10, 1996, abandoned.

[51] Int. Cl.[6] ..... B65D 35/56

[52] U.S. Cl. ..... 222/105; 222/107

[58] Field of Search ..... 222/94, 183, 105, 222/107

[56] References Cited

U.S. PATENT DOCUMENTS

| | | | |
|---|---|---|---|
| 3,081,911 | 3/1963 | Scholle | 222/107 |
| 3,160,323 | 12/1964 | Weisberg | 222/107 |
| 3,173,579 | 3/1965 | Curie et al. | 222/105 |
| 3,205,889 | 9/1965 | Alder et al. | 128/172 |
| 3,260,412 | 7/1966 | Larkin | 222/107 |
| 4,601,410 | 7/1986 | Bond | 222/92 |
| 4,626,456 | 12/1986 | Farrell et al. | 428/35 |
| 4,796,788 | 1/1989 | Bond | 222/94 |
| 4,893,731 | 1/1990 | Richter | 222/92 |
| 4,998,990 | 3/1991 | Richter et al. | 222/105 |
| 5,147,071 | 9/1992 | Rutter et al. | 222/105 |
| 5,207,355 | 5/1993 | Thomsen | 222/95 |

*Primary Examiner*—Philippe Derakshani
*Attorney, Agent, or Firm*—Alan T. McDonald

[57] ABSTRACT

A collapsible bag for use in containing and dispensing a liquid includes a bladder layer and an outer layer. The bladder layer includes a pair of inner opposed panel sections sealed together to provide an enclosed region. The inner panel sections have an inner surface facing the enclosed region and a plurality of ribs formed thereon, and one of the inner panel sections has a first product-dispensing hole therethrough. The outer layer includes a pair of outer opposed panel sections covering the bladder layer and one of the outer panel sections includes a second product-dispensing hole therethrough aligned with the first product-dispensing hole. A spout is attached to the outer layer and covers the first and second product-dispensing holes to provide access to the enclosed region. The bag may be used in a box to dispense liquids.

11 Claims, 9 Drawing Sheets

BAG-IN-BOX AND METHOD AND APPARATUS FOR MAKING THE SAME

This application is a continuation of application Ser. No. 08/678,020 filed Jul. 10, 1996, now abandoned.

FIELD OF THE INVENTION

The present invention relates to collapsible bags. More particularly, the invention relates to collapsible bags used to dispense liquids from a box.

BACKGROUND OF THE INVENTION

Liquids such as wine or soft drink syrups are sometimes dispensed from a box. In the case of wine, the box has a spout with a spigot to allow the consumer a convenient way to pour the wine. In such arrangements, the wine, or whatever product is being dispensed, is held in the box in a collapsible bag. Such bags are referred to in the art as "bag-in-box bags."

Bag-in-box bags are sometimes subjected to vacuum pressure to rapidly drain the bag. In such cases, as the bag is being drained of its liquid product, the bag collapses onto itself, which can cause problems. One of the problems which can occur is that the bag walls can collapse over the spout and seal off the spout. Another problem is that the bag walls collapse into each other and seal off a pocket of the bag which still holds liquid. When this happens, portions of the liquid product are wasted.

In the past, one way to solve these problems was to add a "dip-strip" to the bag. A dip-strip can take the shape of a straw-like hollow insert or a generally rectangular shape with ribs extending along the length of one side thereof and be placed inside the bag and attached to the spout. As the bag is drained, it collapses around the dip-strip. However, dip-strips add to the manufacturing expense, are sometimes difficult to position, may interfere with the process of filling the bag, and sometimes become detached from the spout.

Consequently, a need exists for a bag-in-box bag which overcomes the aforementioned shortcomings associated with existing arrangements.

SUMMARY OF THE INVENTION

In accordance with the present invention, a collapsible bag, used for containing and dispensing a liquid, includes a bladder layer, an outer layer, and a spout. The bladder layer includes a pair of inner opposed panel sections sealed together to provide an enclosed region. The inner panel sections include an inner surface facing the enclosed region and have a plurality of ribs formed thereon. One of the inner panel sections has a first product-dispensing hole therethrough. The plurality of ribs and the first product-dispensing hole are constructed and arranged such that the bag collapses with the plurality of ribs directed toward the first product-dispensing hole to prevent the bladder layer from seal-blocking the hole. The outer layer includes a pair of outer opposed panel sections covering the bladder layer and are sealed together. One of the outer panel sections includes a second product-dispensing hole therethrough aligned with the first product-dispensing hole. The spout is attached to the outer layer and covers the first and second product-dispensing holes to provide access to the enclosed region.

In one implementation, a first of the inner panel sections includes the plurality of ribs, and a second of the inner panel sections is smooth. Each rib is parallel to and extends a majority of the length of the bag.

In another implementation, the ribs are coextruded onto the inner surface of the inner panel sections. The ribs extend through only a central area of the width. The ribs have a height of at least 0.01 inch.

In another implementation, the ribs are extruded in a single layer with the inner panel sections. The ribs have a height of about 0.005 to 0.01 inch and extend across most of the width.

In another implementation, the spout includes a scored surface facing the enclosed region.

The enclosed region contains liquid, and the ribs prevent the inner panel sections from sealing the liquid in the enclosed region away from the spout. The ribs form a series of channels to provide a conduit to the liquid to convey the liquid from the enclosed region to the spout.

In another implementation, an apparatus includes a collapsible bag and a box containing the bag. The bag includes a bladder layer, an outer layer, and a spout. The bladder layer has a pair of inner opposed panel sections sealed together to provide an enclosed region holding a liquid. The inner panel sections include an inner surface facing the enclosed region having a plurality of ribs formed thereon, and one of the inner panel sections has a first product-dispensing hole therethrough. The plurality of ribs and the first product-dispensing hole are constructed and arranged such that the bag collapses with the plurality of ribs directed toward the first product-dispensing hole to prevent the bladder layer from seal-blocking the hole. An outer layer includes a pair of outer opposed panel sections covering the bladder layer and being sealed together, and one of the outer panel sections includes a second product-dispensing hole therethrough aligned with the first product-dispensing hole. A spout is attached to the outer layer and bladder layer and covers the first and second product-dispensing holes to provide access to the liquid in the bladder layer. The box contains the bag and provides access to the spout and the liquid in the bladder layer.

In another embodiment, the invention is directed to a method for making a collapsible bag comprising the steps of providing a first film of a polymeric material; aligning a second film of a polymeric material with the first film; punching a hole into the first and second films; providing a third film of a polymeric material; aligning a fourth film of a polymeric material having a plurality of ribs thereon with the third film; aligning the first, second, third and fourth films together; sealing the first, second, third and fourth films together to form four seals; and cutting along one of the seals to create a plurality of individual bags.

In one implementation, the sealing step includes sealing parallel side edges and sealing parallel top and bottom edges, and precrushing the ribs prior to sealing the parallel top and bottom edges. The step of precrushing the ribs may include ultrasonically welding the ribs. The step of precrushing the ribs may include applying heat to the ribs.

In another implementation, the invention includes an apparatus for making a collapsible bag having a first panel section with a spout and a second panel section with a ribbed surface opposing the spout, comprising a punch for punching a hole into a first film; a spout sealer for inserting a spout over the hole and sealing the spout to the first film;
a precrusher for crushing a ribbed surface on a second film; an edge sealer for providing seals along four edges of the first and second films; and a cutter for cutting the first and second films into an individual bag of first and second panel sections.

In one implementation, the precrusher is an ultrasonic welder for melting the ribbed surface. In another implementation, the precrusher is a heater for melting the ribbed surface.

In another implementation, the edge sealer includes a first sealer for making a pair of parallel side seals, and a second sealer for making a pair of parallel end seals being perpendicular to the side seals. The edge sealer may be a heat sealer.

In yet another implementation, the invention includes a collapsible bag comprising a bladder layer, an outer layer, and a spout. The bladder layer includes a pair of inner opposed panel sections sealed together to provide an enclosed region, and one of the inner panel sections has a first product-dispensing hole therethrough. The outer layer includes a pair of outer opposed panel sections covering the bladder layer and are sealed together, and one of the outer panel sections includes a second product-dispensing hole therethrough aligned with the first product-dispensing hole. The spout has a flange attached to the outer layer and covers the first and second product-dispensing holes, and the flange has a scored surface facing the enclosed region.

In one implementation, the scored surface includes a plurality of upstanding ribs.

In one implementation, the bag further includes a plurality of ribs located on a surface of one of the inner panel sections facing the enclosed region.

In another implementation, the bladder layer and outer layer are heat sealed together along first and second side edges to form first and second side seals, and along top and bottom edges to form top and bottom seals, and the spout is located adjacent to the top seal. The flange may engage the top seal.

The above summary of the present invention is not intended to describe each illustrated embodiment, or every implementation, of the present invention. This is the purpose of the figures and the detailed description which follow.

BRIEF DESCRIPTION OF THE DRAWINGS

Other aspects and advantages of the invention will become apparent upon reading the following detailed description and upon reference to the drawings in which.

Figure 1:
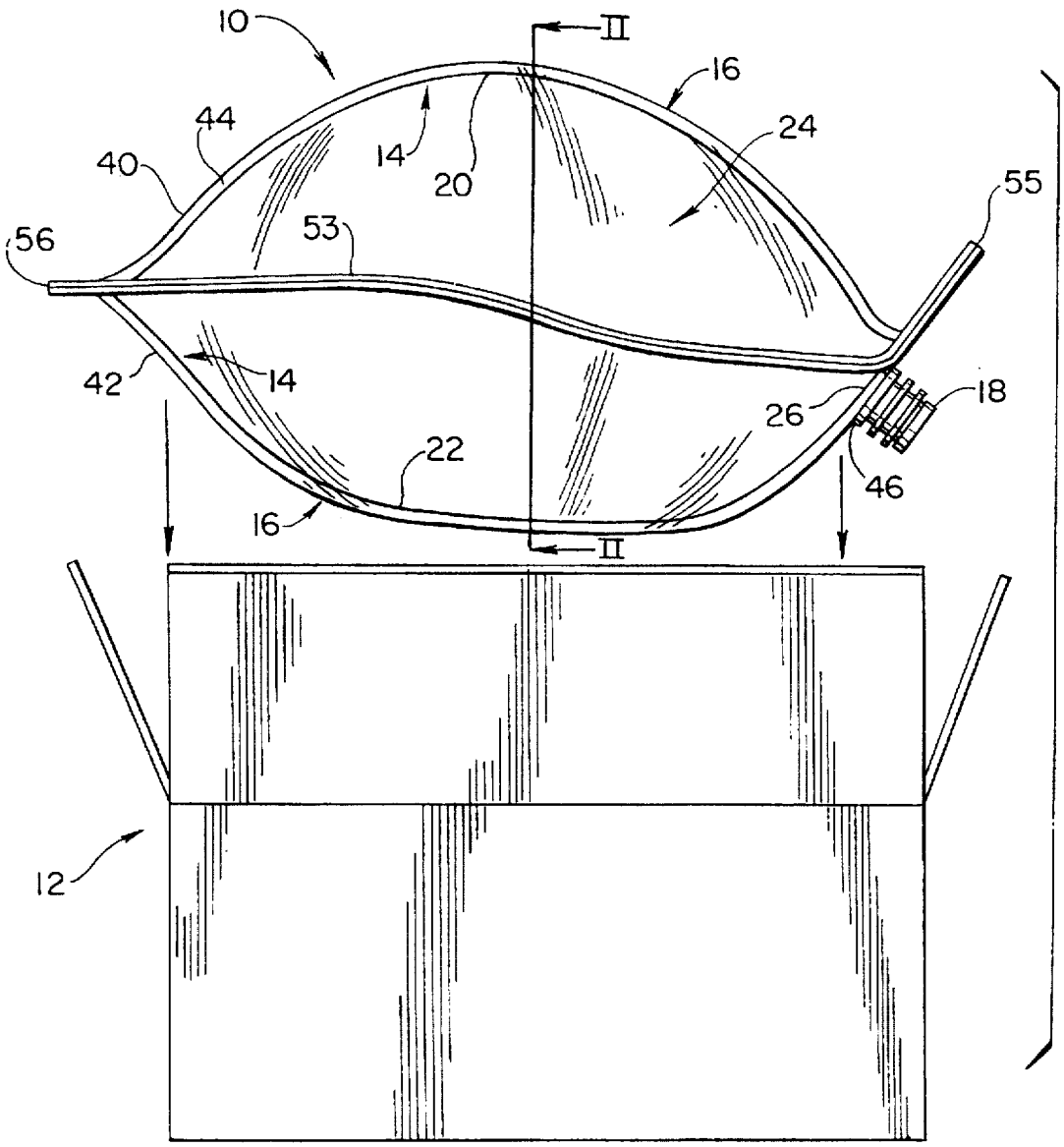
FIG. 1 is a front plan view of a bag-in-box bag, in accordance with the present invention.

While the invention is susceptible to various modifications and alternative forms, specifics thereof have been shown by way of example in the drawings and will be described in detail. It should be understood, however, that the intention is not to limit the invention to the particular implementations and embodiments described. On the contrary, the intention is to cover all modifications, equivalents, and alternatives falling within the spirit and scope of the invention as defined by the appended claims.

DETAILED DESCRIPTION OF THE ILLUSTRATED EMBODIMENTS

FIG. 1 illustrates a typical arrangement in which a bag-in-box bag 10 can be used. Bag 10 is contained in a paperboard box 12 and contains a liquid, for example, wine, soft-drink syrup, or juice. As the liquid is withdrawn, bag 10 collapses, in many applications with the goal of draining all of the liquid out of bag 10. As will be discussed in detail below, the arrangement of the present invention provides this advantage.

Bag 10 includes a bladder layer 14, an outer layer 16 surrounding bladder layer 14, and a spout 18 attached to outer layer 16 to provide access to the liquid in bag 10.

Bladder layer 14 includes a first inner panel section 20 and a second inner panel section 22 opposed to first inner panel section 20. First and second inner panel sections 20, 22 are rectangular in shape and are heat sealed together along all four edges at side seals 53, 54 and top and bottom seals 55, 56 to provide an enclosed region 24. Enclosed region 24 is suitable for holding the liquid being dispensed. Bladder layer 14 may be made from a 0.002 inch thick polyethylene film.

Second inner panel section 22 includes a hole 26 for dispensing the liquid product therethrough. Hole 26 provides access to enclosed region 24 and is for accommodating spout 18. Spout 18 covers hole 26 and is heat sealed to second panel section 22.

Figure 2:
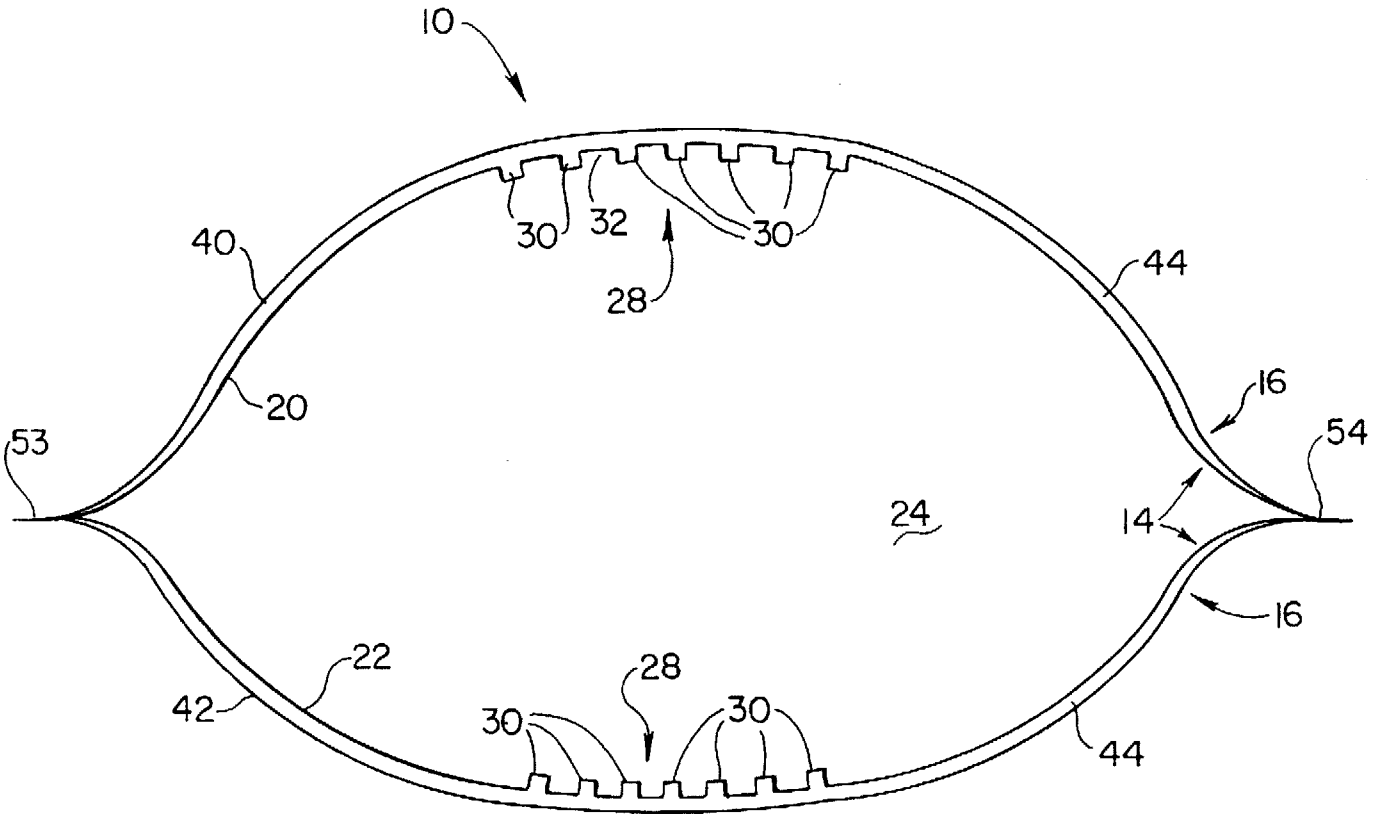
FIG. 2 is a cross-sectional view taken along the line II—II in FIG. 1 of the bag-in-box bag, in accordance with the present invention.
Figure 3:
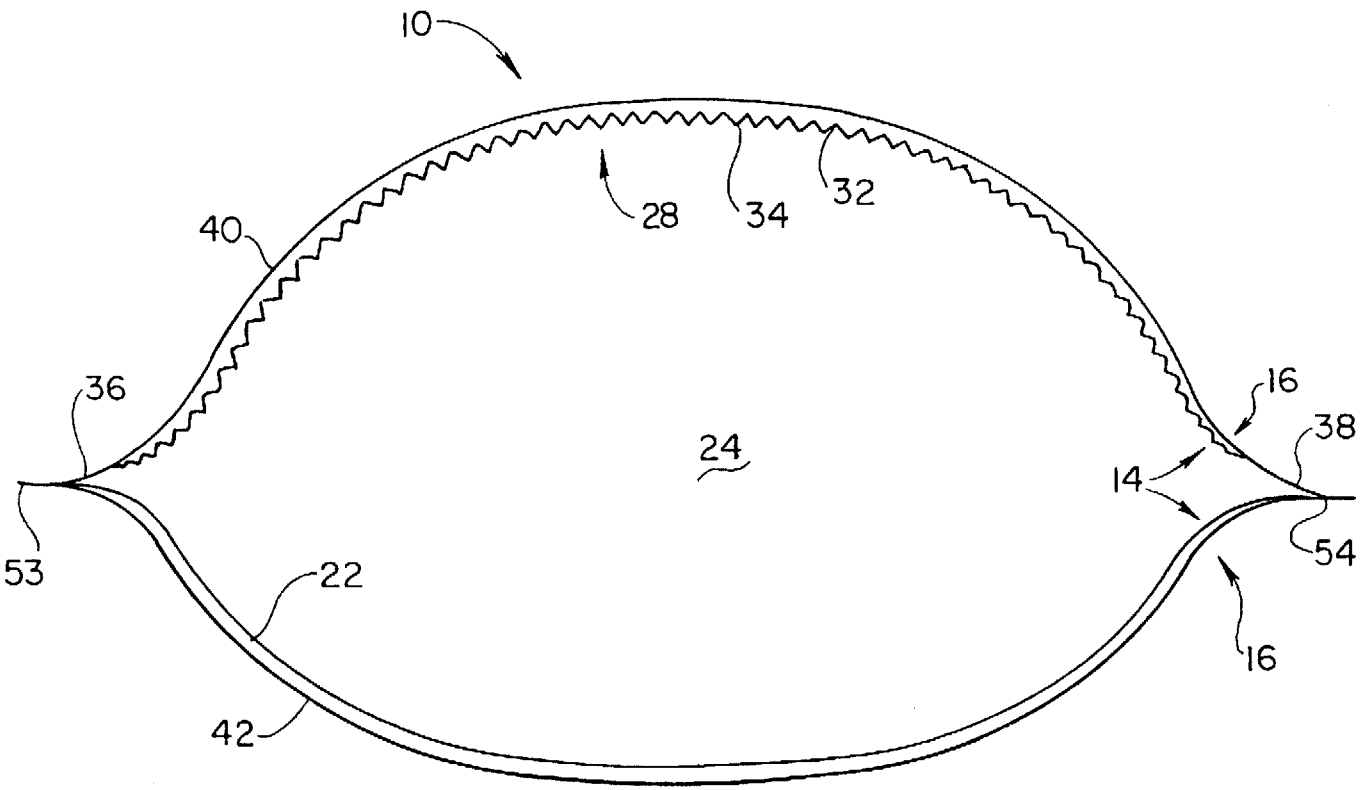
FIG. 3 is an alternative embodiment of a cross-sectional view along the line II—II in FIG. 1 of the bag-in-box bag, in accordance with the present invention.
Figure 4A:
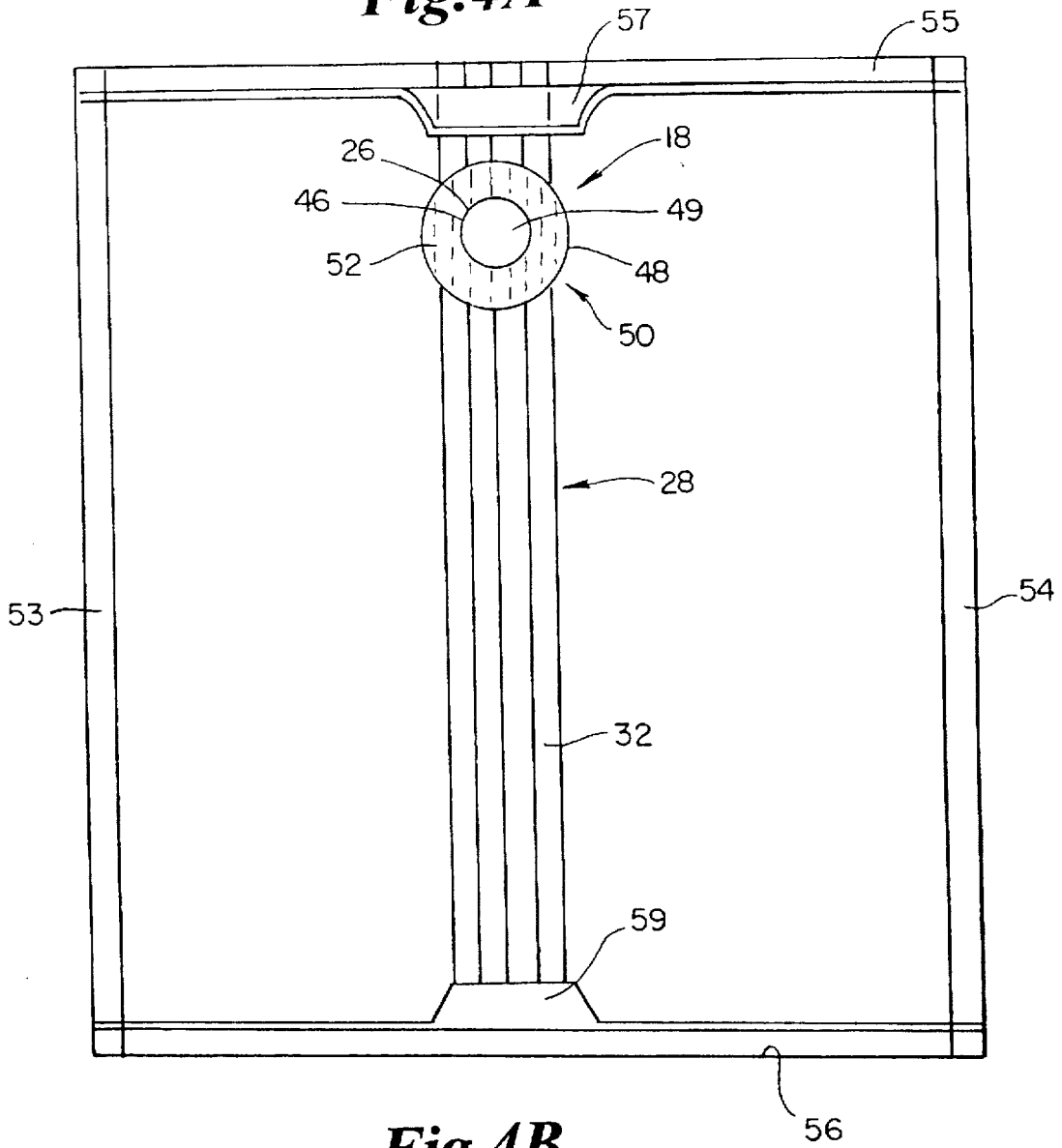
FIG. 4A is a bottom elevational view of the FIG. 1 embodiment of a bag-in-box bag, in accordance with the present invention.

As illustrated in FIGS. 2–4, one or both of first and second inner panel sections 20, 22 have a plurality of ribs 28 on the surface facing enclosed region 24. Ribs 28 are a series of elongated raised narrow surfaces which run parallel to the length of bag 10. FIG. 2 illustrates a cross-section of the bag of FIG. 1. As illustrated in FIG. 2, ribs 28 have the cross section of a square 30 with sizable gaps 32 between each rib 28. In general, the shape of ribs 28 and the size of the gaps 32 in between the ribs will depend upon the width of spout 18 and the viscosity of the liquid being dispensed. In the FIG. 2 embodiment, the rib height is at least 0.03 inch. With ribs 28 of this height, ribs 28 would need to extend only across a portion of the width of the bag, such as right down the central portion. Such an arrangement is illustrated in FIG. 4A. FIG. 4A is a bottom elevational view of bag 10. Spout 18 rests towards one edge of bag 10, and ribs 28 extend parallel to the length of bag 10 but only through the central area of the bag.

In FIG. 2, ribs 28 are shown on both first and second inner panel sections 20, 22. However, it should be understood that it is not required that both panel sections of bladder layer 14 have ribs 28. If only one of first and second inner panel sections 20, 22 has ribs 28, ribs 28 should be on the panel section which is opposite of spout 18. Ribs 28 function to prevent first and second inner panel sections 20, 22 from sealing together and isolating a portion of the liquid away from spout 18. Ribs 28 form a series of channels at gaps 32. These channels act as a conduit to the liquid in bag 10 in order to convey the liquid from enclosed region 24 to spout 18. As such, there is no need for a dip-strip to be added to bag 10 in order to drain the bag. FIG. 4A illustrates how ribs 28 will help convey liquid toward spout 18.

FIG. 3 shows an alternate embodiment of ribs 28. In this particular arrangement, ribs 28 are smaller both in height and in gaps between ribs than in the FIG. 2 embodiment. Ribs in the FIG. 3 embodiment have a height of about 0.005 to 0.01 inch. Ribs 28 include a substantially triangular cross-section 34, but could be other shapes as well. In this particular embodiment, ribs 28 extend across the entire width of bag 10 except for portions 36, 38 at the edges to allow for side sealing. Second inner panel section 22 is illustrated as being smooth, and containing no ribs. However, as in the FIG. 2 embodiment, as an alternative approach, the second inner panel section has ribs on its surface facing the enclosed region.

Outer layer 16 includes a first outer panel section 40 and a second outer panel section 42 opposed to first outer panel section 40 and sealed thereto. First and second outer panel sections 40, 42 are sealed to each other and to first and second inner panel sections 20, 22 along the side seals 53, 54 and top and bottom seals 55, 56. First and second outer panel sections 40, 42 form an enclosed region 44 for enclosing first and second inner panel sections 20, 22. Outer layer 16 functions to provide a barrier structure for bag 10. Also, in case bag 10 might be punctured accidentally, outer layer 16 would be a barrier to bladder layer 14. As such, outer layer 16 can prevent bladder layer 14 from being punctured. Outer layer 16 may be made from an at least 0.002 inch thick coextruded or laminated film structure.

Second outer panel section 42 includes a hole 46 which is aligned with hole 26 on the second inner panel section 22. Spout 18 covers hole 46 and is heat sealed to second outer panel section 42.

Spout 18 is heat sealed to second inner panel section 22 and second outer panel section 42 over holes 26 and 46 in order provide access to enclosed region 24. Spout 18 engages cooperating structure in box 12 in order to dispense the liquid. As illustrated in FIG. 4A, spout 18 includes a base flange 48 surrounding a mouth 49 of the spout. Base flange 48 provides a region to attach spout 18 to bag 10. Base flange 48 may include a scored or grooved surface 50. Scored surface 50 includes several ribs 52 extending parallel to the length of bag 10. Ribs 52 function to prevent one of first and second inner panel sections 20, 22 of bladder layer 14 from sticking to spout 18 and thereby sealing off an area of enclosed region 24. Scored surface 50 holds bladder layer 14 away from mouth 49 of spout 18 and permits liquid to always drain through spout 18. Base flange 48 includes a smooth surface opposite to scored surface 50. This allows for better sealing of spout 18 to bag 10.

It is advantageous to locate spout 18 close to top seal 55. By placing spout 18 in this location, as illustrated in FIG. 4A, the overall width of ribs 28 will be minimized.

FIG. 4A also illustrates wide seal area 57 in top seal 55 and wide seal area 59 in bottom seal 56. Wide seal areas 57 and 59 allow for a larger surface area when sealing along the top and bottom edges in the region of ribs 28. This helps to ensure that ribs 28 are crushed sufficiently to create a tighter seal without leaks.

Figure 4B:
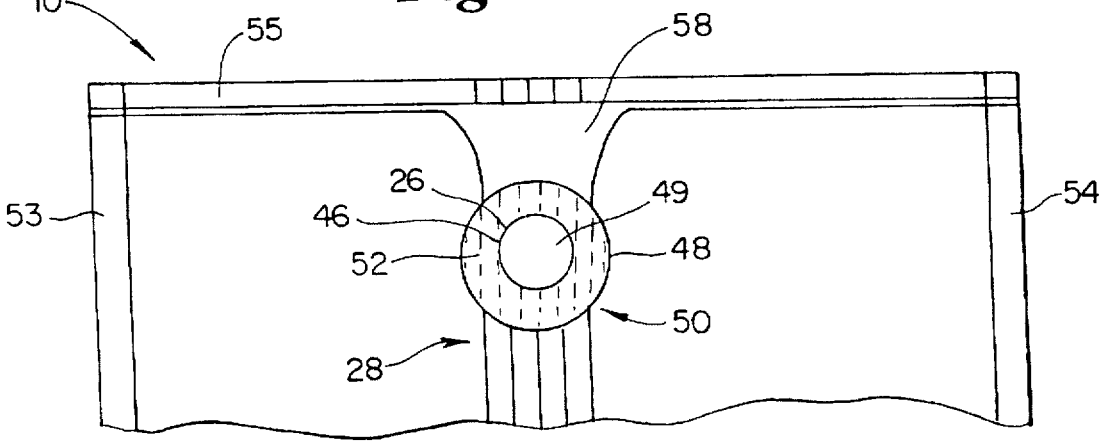
FIG. 4B is a fragmentary bottom elevational view similar to FIG. 4A of an alternate embodiment of a bag-in-box bag, in accordance with the present invention.

FIG. 4B illustrates an alternate embodiment of a seal location. In this implementation, a contoured seal region 58 extends from top seal 55 to base flange 48. Ribs 28 of bladder layer 14 are part of seal 55. This arrangement allows spout 18 and ribs 28 to be very close to each other without actually being sealed together. This helps to control how the bag collapses as it is draining.

It is advantageous to have base flange 48 be square or rectangular in shape so that a straight edge of base flange 48 can be placed next to top seal 55. This results in minimizing shifting of the spout surface of bag 10 with respect to ribs 28.

A method for making the ribs 28 on the bladder layer surface is described below. One such method includes a co-extrusion process.

Figure 5A:
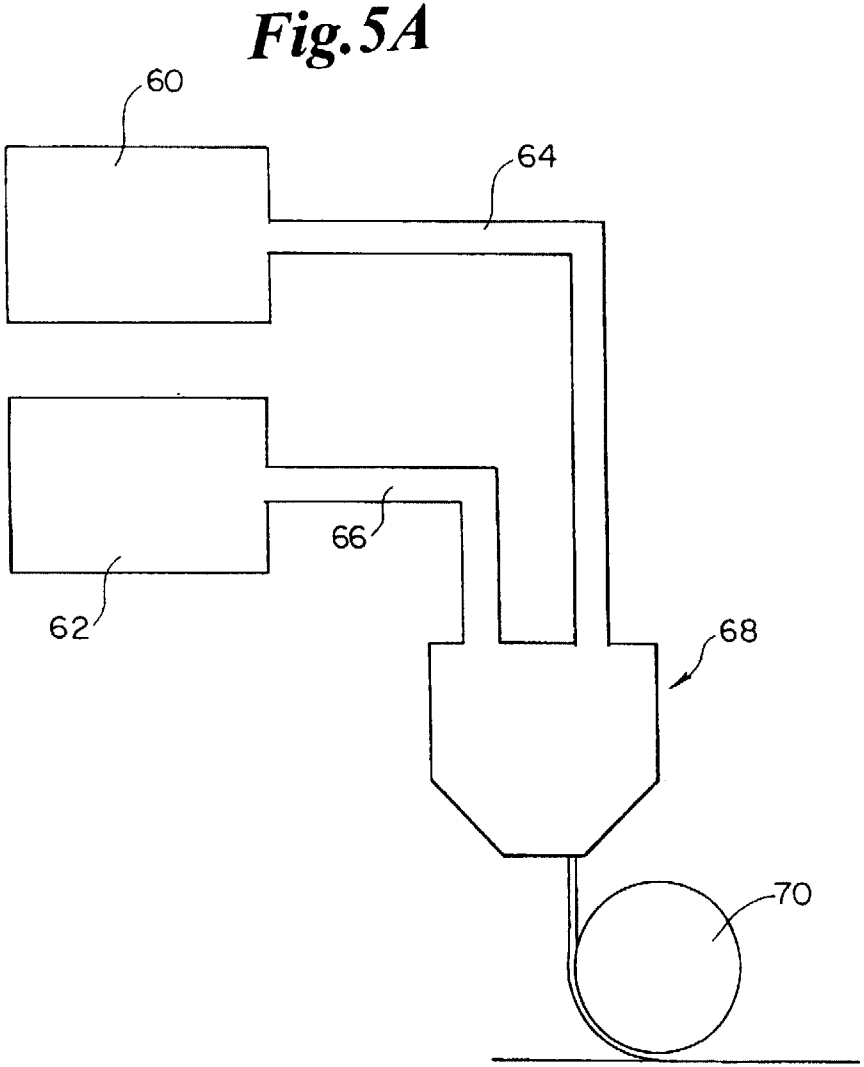
FIG. 5A is a schematic view of an extrusion process for making the bag-in-box bag, in accordance with the present invention.
Figure 5B:
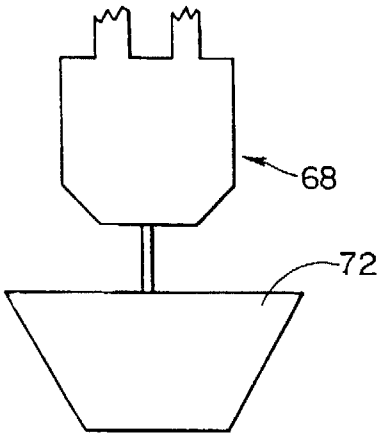
FIG. 5B is a partial schematic view of an alternative embodiment of an extrusion process for making the bag-in-box bag, in accordance with the present invention.

FIGS. 5A and 5B illustrate schematically one of the inner panel sections 20, 22 being extruded with ribs 28 formed thereon. A first extruder 60 contains a molten material for extruding bladder layer 14. A second extruder 62 contains a molten material of a higher melting index than the material in extruder 60 and is for extruding ribs 28. One reason for having ribs 28 being made of a material of a higher melting index is so that when the top and bottom edges of bag 10 are heat sealed together to form seals 55, 56, ribs 28 will quickly melt to result in a flatter and tighter seal and avoid leakage of bag 10. Extruder 60 and 62 extrude into channels 64, 66 and into die 68. From die 68, bladder layer 14 with ribs 28 are extruded onto a chill roll 70 to help cool the material rapidly. Alternatively or in addition to chill roll 70, a water bath 72 may be provided (FIG. 5B). The smooth side, that is the side opposite to the side with ribs 28, is the side which contacts chill roll 70.

Figure 6:
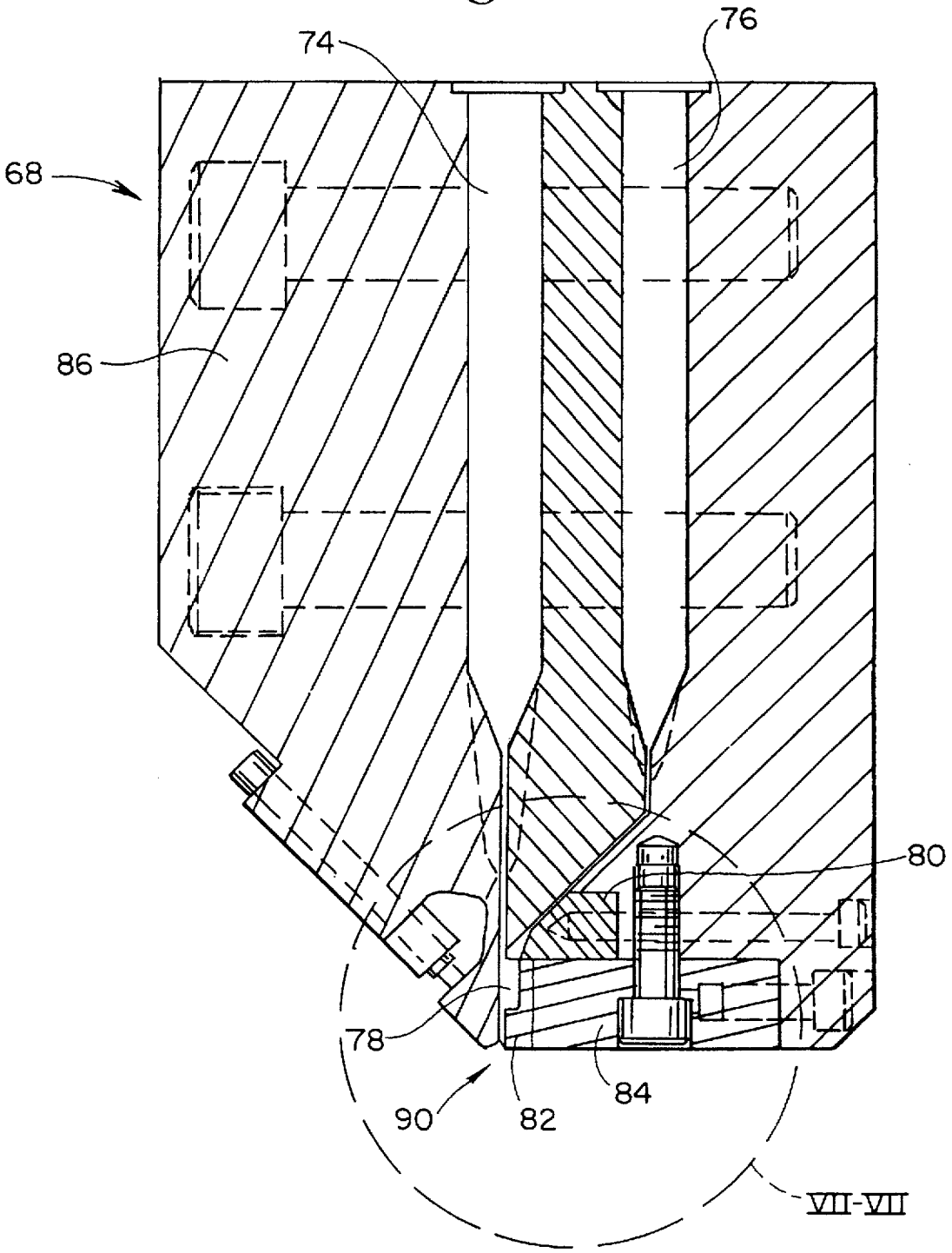
FIG. 6 is a cross-sectional view of a die for making the bag-in-box bag, in accordance with the present invention.

FIG. 6 illustrates a cross-sectional view of die 68. Die 68 includes a first channel 74 for receiving the molten material for making bladder layer 14, and a second channel 76 for receiving the molten material for making ribs 28. The two channels meet in a common pocket at 78. The amount of rib layer material to flow into pocket 78 may be adjusted at choker bar 80. Wedge 82 contains the profile shape of ribs 28, and is a portion of the die responsible for making ribs 28. Die lip 84 is adjustable to control the thickness of the ribbed layer. Die 68 also includes another choker bar at 86 for adjusting the width of first and second channels 74, 76. Further discussion of die 68 may be found in U.S. Pat. No. 5,273,595 to Tomic et al.

Figure 7:
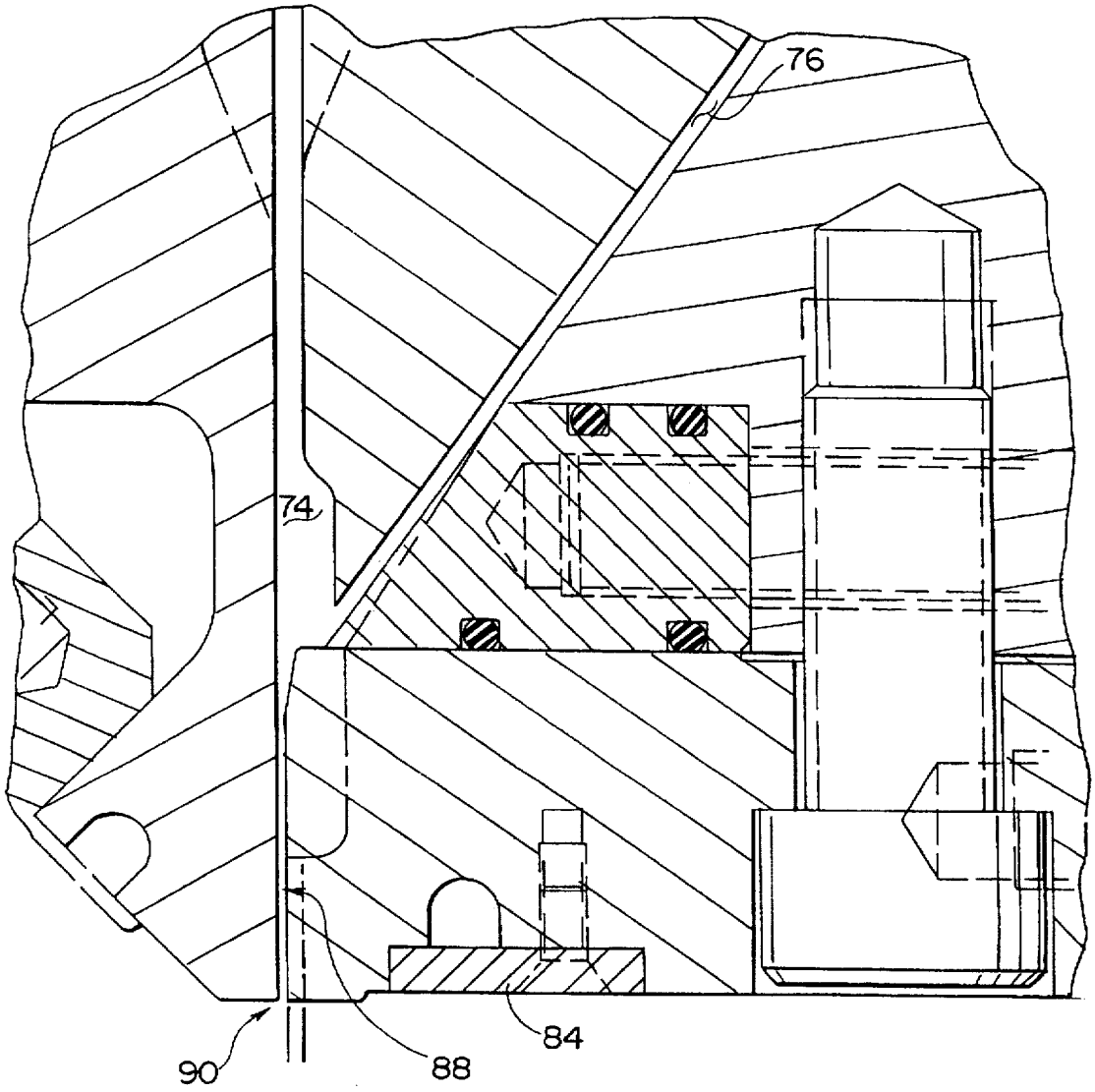
FIG. 7 is an enhanced fragmentary sectional view in the region VII—VII of FIG. 6, in accordance with the present invention.

FIG. 7 is an enlargement of an exit region 90 of die 68. The height of ribs is illustrated as 88. Bladder layer 14 with ribs 28 co-extruded thereon exit die 68 at exit region 90. A sheet of film with a plurality of ribs 28 is pushed from die 68 at exit region 90, and once it is cooled, it is bundled into a roll. The co-extrusion process using the die of FIGS. 6 and 7 are appropriate for making the ribs shown in the embodiment of FIG. 2. That is, the implementation of FIGS. 6 and 7 are particularly advantageous for making ribs of a larger height with larger gaps therebetween.

Figure 8:
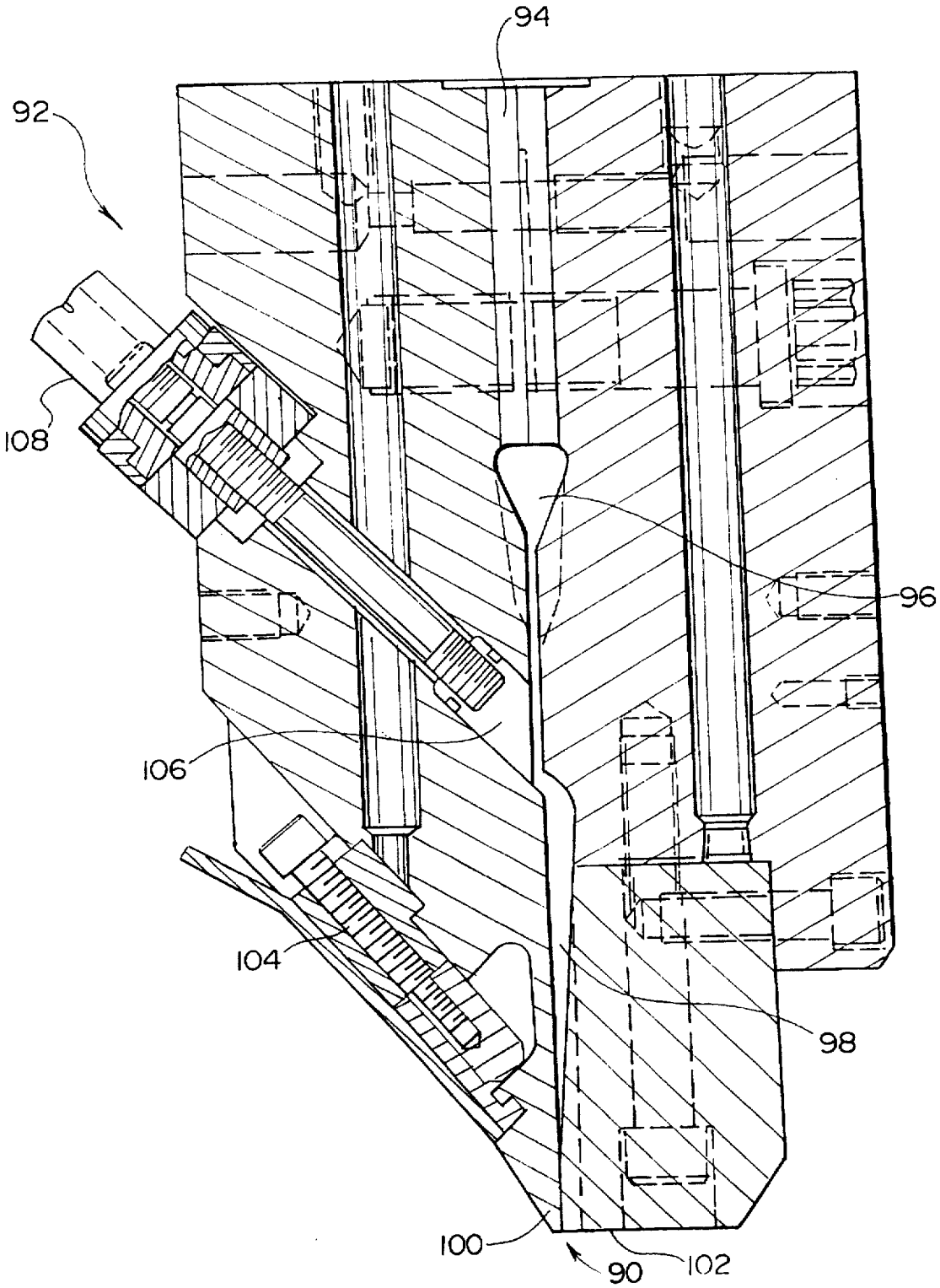
FIG. 8 is a cross-sectional view of another embodiment of a die for making the bag-in-box bag, in accordance with the present invention.

An alternate embodiment to making ribs 28 is illustrated in FIG. 8. The FIG. 8 embodiment is particularly suited to making the implementation shown in FIG. 3. A single layer extruder die is shown in general at 92. In single layer die 92, only one type of molten material is used to make both bladder layer 14 and ribs 28. This is well suited for implementations which include ribs of a very small height with small gaps therebetween. Die 92 includes an input channel 94 with a main manifold 96. Molten material moves down channel 94 through manifold 96 and into slot 98. First and second lips 100, 102 control thickness of bladder layer 14 and ribs 28. Within lip 102 is a series of profiles for making ribs 28. A screw 104 may be tightened or loosened as appropriate to adjust the thickness of bladder layer 14 by acting on lip 100. A choker bar 106, which is adjustable by a screw 108, distributes the molten material to be funneled into slot 98. Bladder layer 14 and ribs 28 are pushed through die 92 and exit at exit region 90. This die is discussed more fully in U.S. Pat. No. 5,284,430 to Tomic et al.

Figure 9:
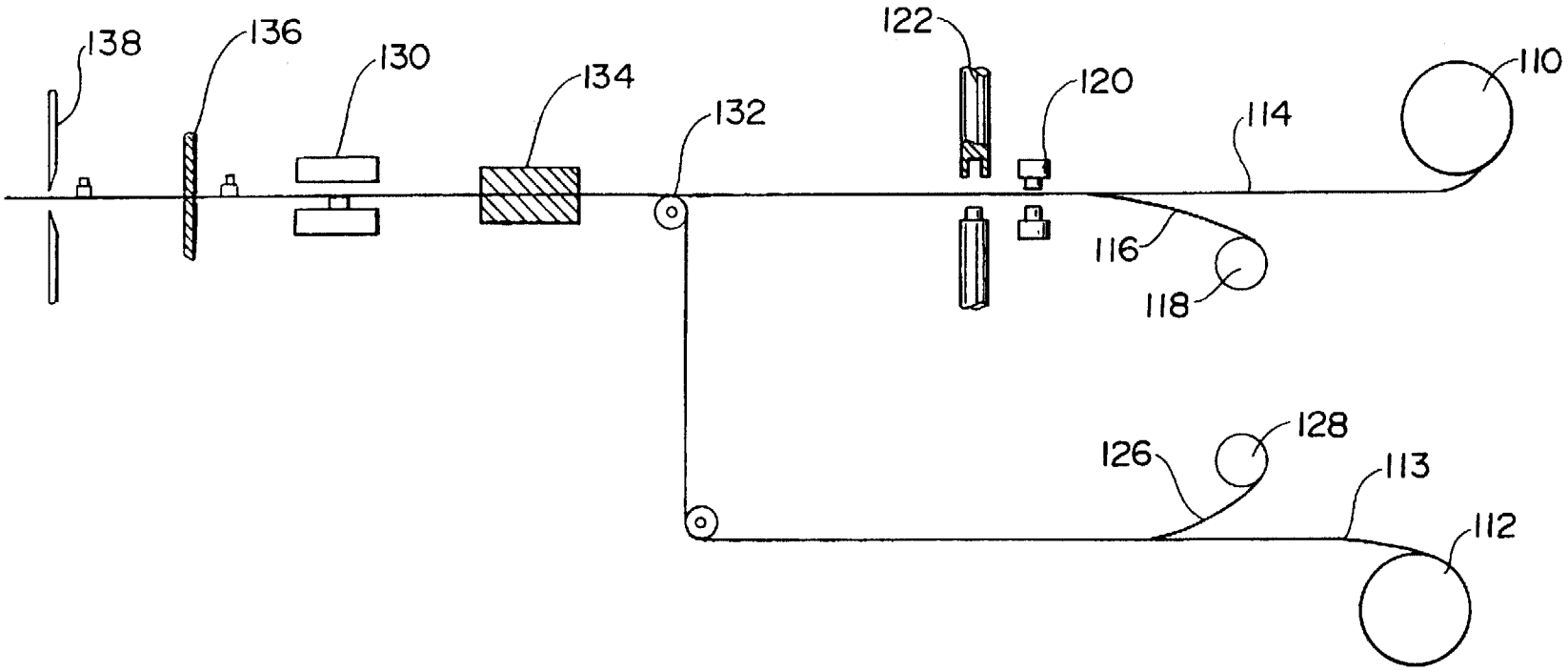
FIG. 9 is a schematic view of an apparatus and process for making the bag-in-box bag, in accordance with the present invention.

A method and apparatus for making bag 10 is illustrated in FIG. 9. A roll 110 of a first polymeric film 114 used for making outer layer 16 is unrolled. First film 114 is aligned with a second film 116 which is unrolled from a roll 118. Second film 116 is one of first and second inner panel sections 20, 22. A puncher 120 punches holes 26, 46 through first and second films 114, 116. A spout inserter 122 then inserts and heat seals spout 18 over holes 26, 46. A third film 113, used for making outer layer 16, is unrolled from roll 112 and is aligned with a fourth film 126. Fourth film 126 is unrolled from roll 128 and is one of first and second inner panel sections 20, 22. Fourth film 126 includes the plurality of ribs 28. At 132, all four layers are aligned together and conveyed to a side sealer 134. Side sealer 134 seals along two parallel sides along the length of bag 10 to form seals 53, 54. A pre-crusher 130 may then be used to crush ribs 28 to ensure a tighter, more secure seal when heat sealing the top and bottom edges. Pre-crusher 130 may include an ultrasonic welder to melt ribs 28, or may include a heater to melt ribs 28. Next, an edge sealer 136 heat seals the top and bottom edges of bag 10 to form seals 55, 56. Finally, a cutter 138 cuts along two of the sealed regions to create an individual bag 10. It is not necessary to precrush if ribs 28 are substantially small, and ribs 28 will sufficiently crush and form an integral seal when side sealer 134 and top and bottom sealer 136 are applied.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

I claim:

1. A collapsible bag comprising:

an outer bag of first and second panel sections heat sealed together to form a first enclosed region;

an inner bag inside of the outer bag positioned in the first enclosed region and including third and fourth panel sections having inner and outer surfaces and heat sealed together and to the first and second panel sections to form a second enclosed region holding a liquid;

the first and third panels having a hole to provide access to the liquid in the second enclosed region;

a spout sealed to the first and third panel sections over the hole;

the fourth panel section having a first plurality of ribs formed integrally as a portion of the inner surface thereof parallel to a length of the fourth panel section and facing the second enclosed region and without any reinforcement thereof; and the third panel section having a second plurality of ribs formed integrally as a portion of the inner surface thereof facing the second enclosed region, the ribs on said third and fourth panel sections not interlocking with one another as the bag collapses.

2. The bag of claim 1, wherein the ribs prevent the third and fourth panel sections from sealing the liquid in the second enclosed region away from the spout.

3. The bag of claim 1, wherein the ribs provide a conduit to the liquid to convey the liquid from the second enclosed region to the spout.

4. The bag of claim 1, wherein the ribs are coextruded as a portion of the third and fourth panel sections.

5. The bag of claim 1, wherein the ribs are extruded in a single layer as a portion of the third and fourth panel sections.

6. The bag of claim 1, wherein the spout includes a scored surface facing the second enclosed region.

7. A collapsible bag for use in containing and dispensing a liquid comprising:

a bladder layer including a pair of inner opposed panel sections having inner and outer surfaces and sealed together to provide an enclosed region, each of the inner opposed panels having a plurality of ribs formed integrally as a portion of the inner surface thereof and facing the enclosed region and without any reinforcement thereof, wherein the ribs on the inner panel sections do not interlock with one another as the bag collapses, and one of the inner panel sections having a first product-dispensing hole therethrough;

an outer layer including a pair of outer opposed panel sections covering the bladder layer and being sealed together, and one of the outer panel sections including a second product-dispensing hole therethrough aligned with the first product dispensing hole; and a spout having a flange attached to the outer layer and covering the first and second product-dispensing holes, and the flange having a scored surface facing the enclosed region.

8. The bag of claim 7, wherein the scored surface includes a plurality of upstanding ribs.

9. The bag of claim 7, wherein:

the bladder layer and outer layer are heat sealed together along first and second side edges to form first and second side seals, and along top and bottom edges to form top and bottom seals;

and wherein the spout is located adjacent to the top seal.

10. The bag of claim 9, wherein the flange engages the top seal.

11. The bag of claim 7, wherein the enclosed region contains liquid, and the scored surface prevents the inner panel sections from sealing the liquid in the enclosed region away from the spout.

* * * * *